United States Patent [19]

Otaki

[11] Patent Number: 4,990,065

[45] Date of Patent: Feb. 5, 1991

[54] PLUNGER PUMP

[75] Inventor: Mizuo Otaki, Kanagawa, Japan

[73] Assignee: Atsugi Motor Parts Company, Limited, Kanagawa, Japan

[21] Appl. No.: 355,631

[22] Filed: May 23, 1989

[30] Foreign Application Priority Data

May 23, 1988 [JP] Japan ..... 63-66792[U]

[51] Int. Cl.[5] ..... F04B 1/04; F04B 7/04

[52] U.S. Cl. ..... 417/273; 417/490; 417/423.14

[58] Field of Search ..... 417/273, 489, 490, 495, 417/498, 423.14

[56] References Cited

U.S. PATENT DOCUMENTS 2,368,132 3/1944 French ..... 417/571

FOREIGN PATENT DOCUMENTS 2061962 6/1972 Fed. Rep. of Germany ..... 417/490
3120574 12/1982 Fed. Rep. of Germany ..... 417/273
2606836 11/1986 France ..... 417/273
5366 9/1987 World Int. Prop. O. ..... 417/423

*Primary Examiner*—Leonard E. Smith
*Assistant Examiner*—John A. Savio, III
*Attorney, Agent, or Firm*—Bachman & LaPointe

[57] ABSTRACT

A plunger pump including a plurality of plunger chambers, each slidably accommodating a plunger associated with a rotatable cam shaft having an eccentric cam for pressurizing fluid within said plunger chamber, comprises an essentially cylindrical casing with the plunger chamber and a partition wall dividing an internal space defined within the casing into a low-pressure chamber communicaitng through a fluid passage formed in type plunger with the plunger chamber and a high-pressure for receiving the pressurized fluid from the plunger chamber. The casing and the partition wall are integrally formed. The casing has a circular opening through which the shaft is inserted into the low-pressure chamber and another circular opening which is sealingly closed by a lid having high-rigidity. The casing also has an inlet port through which fluid is introduced into the low-pressure chamber and an outlet port through which the pressurized fluid is discharged from the high-pressure chamber.

3 Claims, 2 Drawing Sheets

PLUNGER PUMP

BACKGROUND OF THE INVENTION

1. Field of The Invention

The present invention relates to a plunger pump having a plurality of plungers for discharging pressurized fluid by a reciprocating motion thereof. Specifically to a compact type of plunger pump in which low-pressure and high-pressure chambers for fluid are integrally formed in the casing thereof.

2. Description of The Prior Art

Recently, there have been proposed and developed various plunger pumps with a plurality of plungers to pressurize and discharge fluid such as oil by a reciprocating motion thereof. In such prior art plunger pumps, each of the plungers is reciprocated by a rotational movement of an eccentric cam whose cam surface abuts the mating surfaces of each plunger in such a manner that the above mentioned mating surfaces are normally biased to the above mentioned cam surface by means of a compression coil spring.

One such plunger pump is disclosed in the Japanese Patent First Publication (Tokkai) Showa 60-60370. The construction of such a plunger pump is shown in FIG. 1 illustrating its sectional view.

As schematically shown in FIG. 1, conventionally, the prior art plunger pump 1 is a two split type of plunger pump including a first half 1*a* wherein a low-pressure chamber 3 is defined, and a second half 1*b* wherein a high-pressure chamber 4 is defined. Referring now to FIG. 1, the low-pressure chamber 3 communicates through an oil passage 3*b* with an inlet port 3*a* which is connected through a conduit tube (not shown) to an oil tank (not shown), as is well known. A plurality of plungers 5 are provided in the first half 1*a*. Each of these plungers 5 is reciprocated by the rotational movement of an eccentric cam 6 whose cam surface abuts the mating surfaces of each plunger 5 such that the mating surfaces are normally biased to the cam surface by means of a compression coil spring 7*a*. The eccentric cam 6 is firmly fixed to a cam shaft 2 of the plunger pump 1. In general, the cam shaft 2 is driven by an engine (not shown) through a pulley (not shown) which is securely fixed by a woodruff key (not shown) inserted into a key-seat formed in the vicinity of the one end thereof. When the plunger 5 moves radially to the direction of the central axis of the cam shaft 2 in accordance with the rotational movement of the cam 6, openings 5*a* of the plunger 5 are exposed to the low-pressure chamber 3. Therefore, oil in the low-pressure chamber 3 is introduced into a pressurizing chamber 7. After this, as the plunger 5 moves away from the central axis, the openings 5*a* are closed and then the oil within the chamber 7 is pressurized. The pressurized oil is supplied from the chamber 7 via an oil passage 8 through a check valve 9 into a high-pressure chamber 4. The high-pressure oil in the chamber 4 is then supplied through an outlet port 4*a* into a driving element, for example, a control valve for controlling a steering gear of a power steering system.

In the above mentioned prior art plunger pump, as clearly seen in FIG. 1, the first half 1*a* for the low-pressure chamber 3 and the second half 1*b* for the high-pressure chamber 4 are separately formed. These halves 1*a* and 1*b* are connected to each other substantially at the center of the plunger pump assembly by a fastening means, such as bolts. However, in this construction, since both halves 1*a* and 1*b* are connected to each other by means of bolts, such a plunger pump assembly requires high-rigidity at the connecting portion because of the bolts. As a result, the plunger pump assembly must be of relatively large size. Such a plunger pump assembly tends to leak oil at the connecting section between the two halves 1*a* and 1*b* due to fluctuation in the tightening torque of the bolts. Furthermore, in the prior art plunger pump, there is the possibility that the fastening bolts may be loosened due to vibrations created during operation of the pump, thereby resulting in oil leakage. The prior art plunger pump requires a relatively long time for maintenance, because removal and installation of the fastening bolts is necessary.

SUMMARY OF THE INVENTION

It is, therefore in view of the above disadvantages, an object of the present invention to provide a compact type of plunger pump in which high-pressure and low-pressure chambers for fluid are integrally formed in a single casing thereof.

It is another object of the invention to provide a plunger pump with optimum maintainability.

In order to accomplish the aforementioned and other objects, a plunger pump including at least one plunger chamber slidably accommodating a plunger associated with a rotatable cam shaft having a driven connection with an engine, for pressurizing fluid within the plunger chamber, comprises a substantially cylindrical member for defining an internal space therein, the cylindrical member having an inlet port for introducing fluid into the internal space and an outlet port for discharging fluid from the internal space, a partition member radially and inwardly extending from the inner peripheral wall of the cylindrical member, for dividing the internal space of the cylindrical member into a low-pressure chamber communicating with the inlet port and a high-pressure chamber communicating with the outlet port, the partition member is integrally connected to the cylindrical member, means for blocking and establishing communication between the plunger chamber and the low-pressure chamber depending on the position of the plunger during reciprocating operation of the plunger, and means for communicating the plunger chamber with the high-pressure chamber.

According to another aspect of the invention, a plunger pump including at least one plunger chamber slidably accommodating a plunger associated with and radially arranged relative to a rotatable cam shaft having a driven connection with an engine, for pressurizing fluid within the plunger chamber, comprises a substantially cylindrical member for defining an internal space therein, the cylindrical member having an inlet port for introducing fluid into the internal space and an outlet port for discharging fluid from the internal space, a partition member radially and inwardly extending from the inner peripheral wall of the cylindrical member, for dividing the internal space of the cylindrical member into a low-pressure chamber communicating with the inlet port and a high-pressure chamber communicating with the outlet port, the partition member being integrally connected to the cylindrical member, means for blocking and establishing communication between the plunger chamber and the low-pressure chamber depending on the position of the plunger during reciprocating operation of the plunger, the means being formed in the outer peripheral wall of the plunger, and means for communicating the plunger chamber with the high-pressure chamber, the communicating means being formed in the partition member. The communicating means has a corresponding threaded opening communicated therewith via the partition member. The opening is exposed to the high-pressure chamber for mounting a check valve on the partition member in such a manner so as to introduce flow of the pressurized fluid from the plunger chamber into the high-pressure chamber and to block flow of the pressurized fluid from the high-pressure chamber to the plunger chamber.

According to a further aspect of the invention, a plunger pump including at least one plunger chamber slidably accommodating a plunger associated with and radially arranged relative to a rotatable cam shaft having a driven connection with an engine, for pressurizing fluid within the plunger chamber, comprises a substantially cylindrical member for defining an internal space therein, the cylindrical member having an inlet port for introducing fluid into the internal space and an outlet port for discharging fluid from the internal space, a partition member radially and inwardly extending from the inner peripheral wall of the cylindrical member, for dividing the internal space of the cylindrical member into a low-pressure chamber communicating with the inlet port and a high-pressure chamber communicating with the outlet port, the partition member being integrally connected to the cylindrical member, means for blocking and establishing communication between the plunger chamber and the low-pressure chamber depending on the position of the plunger during reciprocating operation of the plunger, the means being formed in the outer peripheral wall of the plunger; means for communicating the plunger chamber with the high-pressure chamber, the communicating means being formed in the partition member, the communicating means having a corresponding threaded opening which is communicated therewith via the partition member and which is exposed to the high-pressure chamber for mounting a check valve on the partition member in such a manner so as to introduce flow of the pressurized fluid from the plunger chamber into the high-pressure chamber and to block flow of the pressurized fluid from the high-pressure chamber to the plunger chamber. The cylindrical member defining a first opening through which the cam shaft is inserted into the low-pressure chamber and a second opening through which the check valve is inserted into the high-pressure chamber. The plunger pump further comprises means for sealingly closing the second opening in such a manner so as to be proof against high-pressure of the pressurized fluid from the plunger chamber. The plunger pump further comprises means for supporting one end of the rotatable shaft, the supporting means including a cylindrical hollow formed in the partition member. The closing means is firmly supported by a lock ring inserted into a groove formed in the inner peripheral wall of the cylindrical member and a compression spring arranged within the high-pressure chamber for normally biasing the closing means to the lock ring.

BEST MODE FOR CARRYING OUT THE INVENTION

Figure 1:
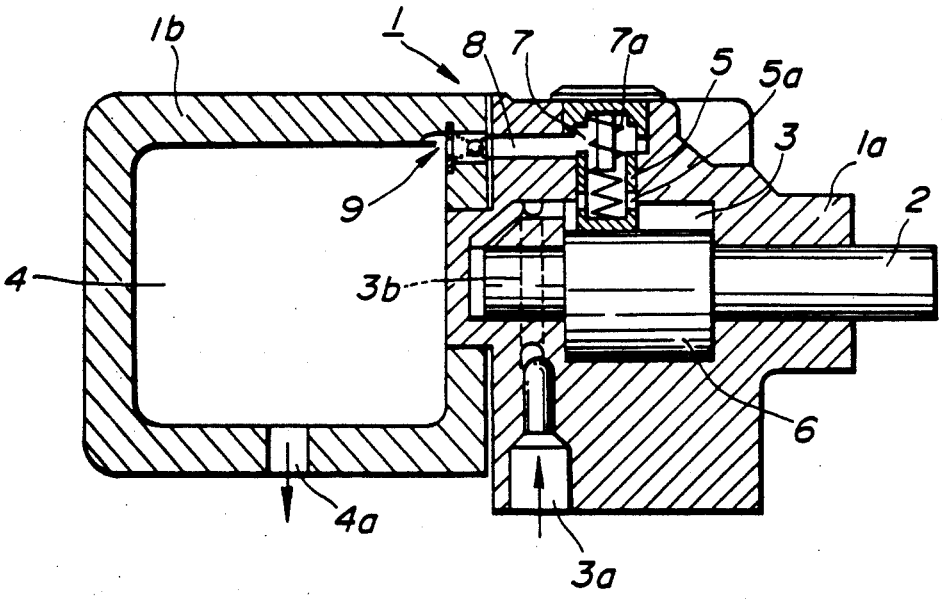
FIG. 1 (PRIOR ART)
FIG. 1 is a longitudinal section illustrating a prior art, two split type of plunger pump assembly including a low-pressure casing and a high-pressure casing.
Figure 2:
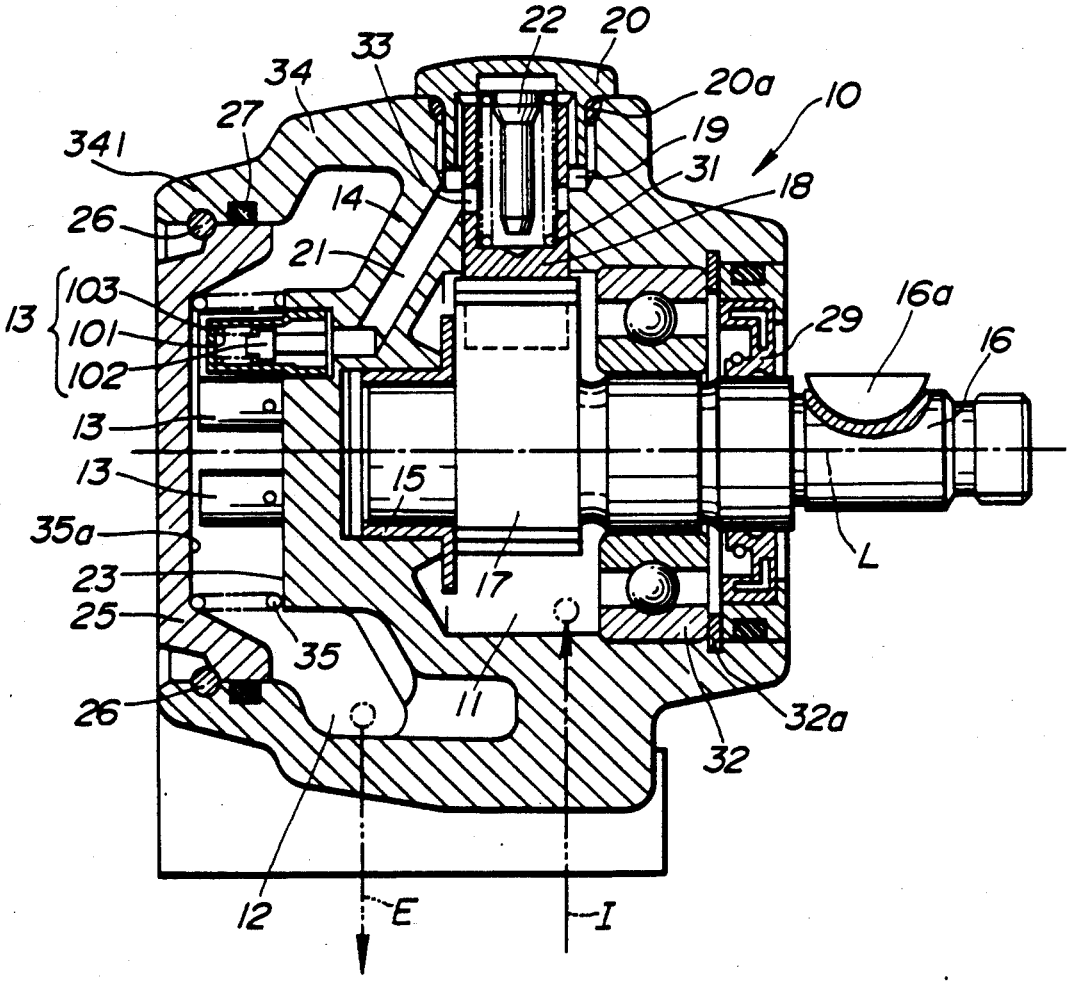
FIG. 2 is a longitudinal sectional view illustrating a plunger pump according to the invention comprised of a single casing in which low-pressure and high-pressure chambers are integrally formed.
Figure 4:
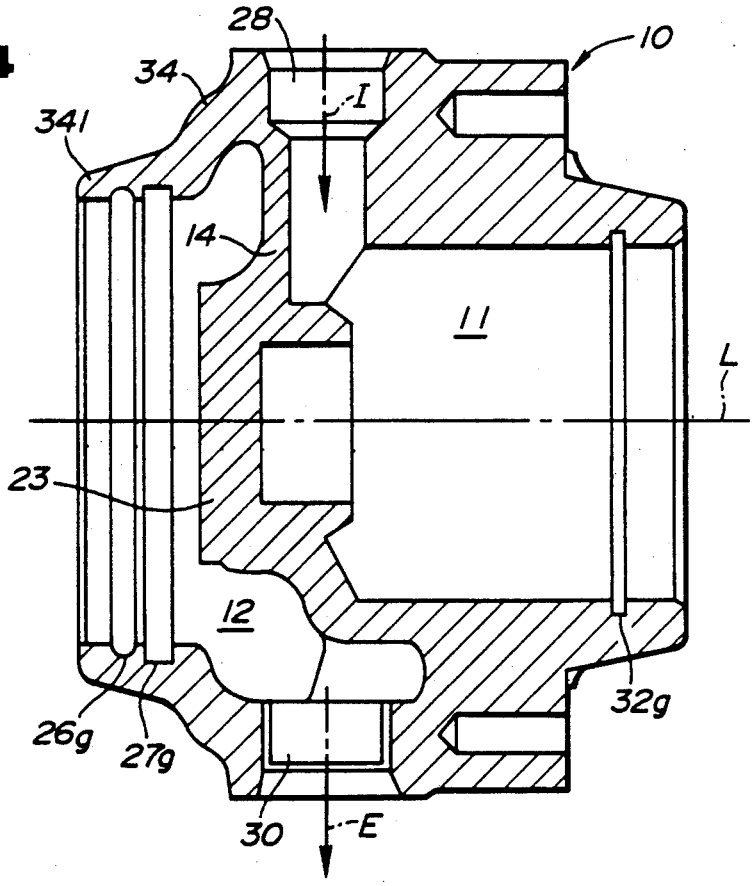
FIG. 4 is a sectional view taken along line III—III shown in FIG. 3 illustrating the single plunger casing of the invention.

Referring now to the drawings, particularly to FIG. 2, the plunger pump assembly 10 of the invention includes a substantially cylindrical casing 34 in which a partition wall 14 is provided to divide an internal space within the casing 34 into a low-pressure chamber 11 and a high-pressure chamber 12. As shown on the right-hand side of FIG. 2, one end of the cam shaft 16 is inserted through the right bore of the casing 34 into the low-pressure chamber 11 and then the one end is rotatably and coaxially supported by means of an annular bearing 15 which is inserted into a cylindrical center hollow formed in the partition wall 14 in such a manner that the outer surface of the bearing 15 is tightly press fitted to the inner surface of the above mentioned center hollow. The annular bearing has a flange portion mating with the left end surface of an eccentric cam 17 which is firmly fixed on the cam shaft 16. In this construction, the cam shaft 16 is positioned in a predetermined set position wherein the left end surface of the cam 17 abuts with the flange portion of the bearing 15. Further, the cam shaft is rotatably supported by a radial bearing 32 at a substantially center portion of the cam shaft slightly away from the right end surface of the cam 17. The radial bearing 32 is coaxially arranged in the right bore of the casing 34. The radial bearing 32 is stopped by a stopper **32*a*, such as a C-type retaining ring or a snap ring, at the right end of the outer ring of the bearing 32. The stopper 32*a* is inserted into a square ended groove 32*g* formed on the right bore of the casing 34 as best seen in FIG. 4. As is generally known, an annular oil seal 29 is inserted into the right end of the right bore of the casing 34 such that the outer peripheral surface of the oil seal 29 sealingly mates with the inner peripheral surface of the right bore and the inner peripheral surface of the oil seal 29 sealingly mates with the outer peripheral surface of the cam shaft 16. The cam shaft 16 is driven by an engine (not shown) through a pulley (not shown) which is securely fixed by a woodruff key 16*a* inserted into a key-seat formed in the vicinity of the other end thereof. The cam shaft 16 has a screw thread at this end through which a nut (not shown) is screwed so as to prevent the pulley from releasing in the axial direction of the cam shaft 16**.

Figure 3:
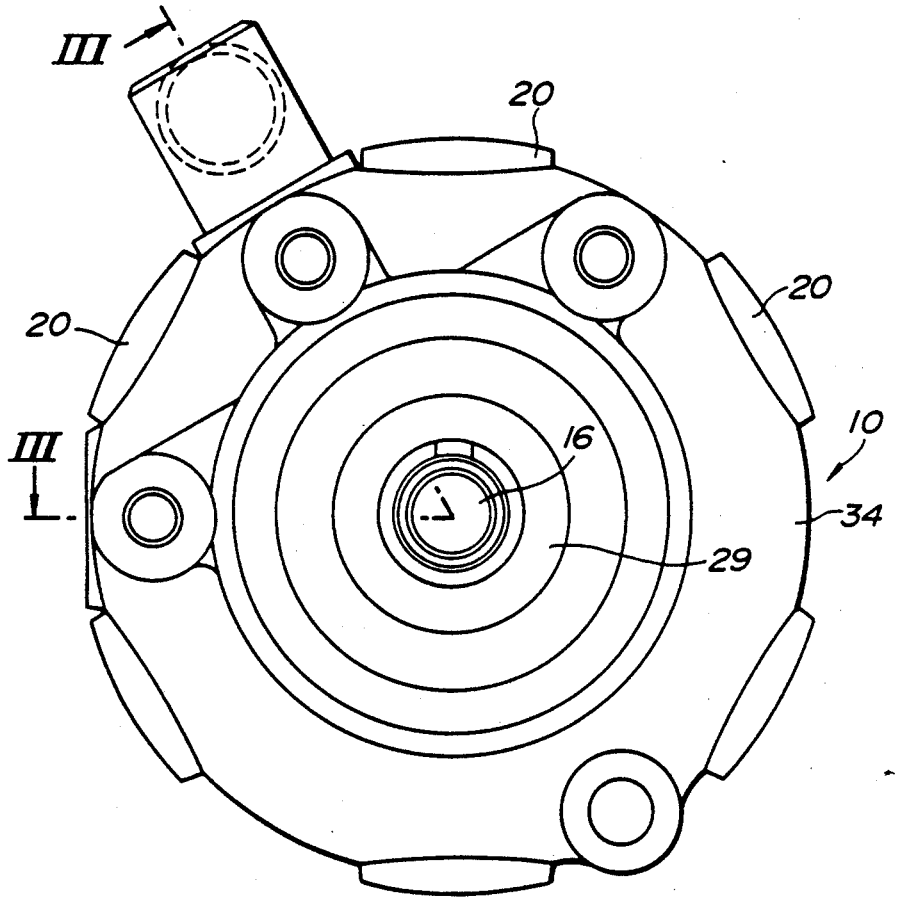
FIG. 3 is an end view of the cam shaft side of the plunger pump according to the invention shown in FIG. 2.

At a substantially center portion of the casing 34, six plunger chambers 19 are formed on the outer peripheral wall of the casing 34 in such a manner that each longitudinal axis of the plunger chambers 19 is radially arranged relative to the central axis L of the cam shaft 16 at regular intervals as will be appreciated from FIG. 3 illustrating the respective positions of six plugs 20 each of which is screwed so as to seal each of the plunger chambers 19. For this reason, the plugs 20 are comprised of a lid portion and a substantially cylindrical thread portion. As the thread portion of a plug 20 is screwed in the direction of the central axis L of the cam shaft 16 an O-ring **20*a*, which is provided around the outer periphery of the threaded portion in the corner between the lid portion and the threaded portion, is deformed in an air-tight fashion, thereby resulting in high sealing performance of the plugs 20 relative to the plunger chamber 19. Furthermore, the plugs 20 include a spring retainer 22 projected to the central axis L so as to support and guide a compression coil spring 31. Each of six cylindrical plungers 18 are slidably accommodated in each of the six plunger chambers 19 such that the inner peripheral wall of the plunger 18 hermetically covers the outer periphery of the spring 31. The plunger chamber 19 is communicated through a fluid passage 21, which is formed in the partition wall 14, via a check valve 13 with the high-pressure chamber 12. The head portion of the plunger 18 is normally biased to the center axis L of the cam shaft 16 by means of the spring 31 in such a manner that the head portion continuously mates with the cam surface of the cam 17 during operation of the plunger pump 10. On the other hand, the other end of the plunger 18 is slidably arranged between the inner peripheral wall of the threaded portion of the plug 20 and the outer periphery of the spring 31. In this manner, the low-pressure chamber 11 is defined by the right-hand wall of the partition wall 14, the inner wall of the plunger casing 34, the oil seal 29, and the heads of six plungers 18**.

The plunger is operable between a first position wherein the head portion of the plunger 18 is proximate to the central axis L and a second position wherein the head portion is away from the central axis L at a maximum value. The head of the plunger 18 shown by a continuous line in FIG. 2 is positioned in the second position, while the head of the plunger 18 shown by a broken line in FIG. 2 is positioned in the first position. When the plunger 18 moves from the second position to the first position, intake ports 33, which are bored in substantially the center of the cylindrical portion of each plunger 18, are exposed to the low-pressure chamber 11 with the result that fluid within the chamber 11 is introduced through the intake ports 33 into the plunger chamber 19. Subsequently, when the plunger 18 moves from the first position to the second position, the intake ports 33 are temporarily closed by the inner wall of the plunger chamber 19 in a manner so as to prevent communication between the plunger chamber 19 and the low-pressure chamber 11. As a result, the fluid within the plunger chamber 19 is pressurized in accordance with the stroke of the plunger 18 from the first position to the second position. The pressurized fluid within the plunger chamber 19 is fed through the fluid passage 21 via the check valve 13 into the high-pressure chamber 12. Although only one fluid passage 21 is shown in FIG. 2, six fluid passages 21 are essentially formed in the partition wall 14 in a manner so as to communicate with each respective plunger chamber 19. As set forth above, each opening end of the fluid passages 21 is communicated through the corresponding check valve 13, which is provided on the central projecting portion 23 of the partition wall 14, within the high-pressure chamber 12. The check valve 13 is comprised of a compression coil spring 101, a valve element 102 normally biased to the fully closed position of the opening of the fluid passage by means of the spring 101, and a substantially cylindrical valve element 103. The cylindrical valve element 103 has a screw thread section which is screwed into the internal thread formed in the projecting portion 23.

On the other hand, as shown on the left-hand side of FIG. 2, the high-pressure chamber 12 is defined by the left-hand wall of the partition wall 14, the inner wall of the plunger casing 34, and a dished lid 25 having a relatively high rigidity. The dished lid 25 has a frustoconical hollow in which one end of a compression coil spring 35 is received. The other end of the coil spring 35 is arranged on the central projecting portion 23 in such a manner to surround the six check valves 13 which are circularly arranged on the flat surface of the projecting portion 23. In this manner, the coil spring 35 is provided between the flat surface of the projecting portion 23 and the inner surface **35*a* of the lid 25 in a compressed state, with the result that the lid 25 is normally biased to the left direction relative to the casing 34 in FIG. 2. That is, the inner surface 35*a* and the flat surface of the projecting portion 23 function as spring seats. The lid 25 is inserted into a substantially annular rim portion 341 of the casing 34 in such a manner that the outer peripheral surface of the lid 25 mates with the inner peripheral surface of the rim portion 341. The lid 25 is locked by an annular lock ring 26 which is inserted into a round bottomed groove 26*g* as best shown in FIG. 4. Furthermore, the rim portion 341 has a square bottomed groove 27*g* at the inner peripheral surface thereof as best seen in FIG. 4. The oil seal 27 is inserted into the groove 27*g* so as to seal between the rim portion 341 and the lid 25. As set forth above, the lid 25 is not supported by bolts, but by the lock ring 26 and the compression spring 35**.

The previously mentioned plunger pump is applicable as a hydraulic oil circuit used for power steering systems in automotive vehicles. As best shown in FIG. 4, low-pressure oil stored within an oil tank (not shown) of the hydraulic circuit, is supplied through an intake conduit I, which is connected to an inlet port 28 communicating with the low-pressure chamber 11, into the low-pressure chamber 11, while high-pressure oil within the high-pressure chamber 12 is fed through a outlet port 30, which is connected to a discharge conduit E, into a control valve (not shown) for controlling a steering gear of the power steering system.

The operation of the plunger pump 10 is as follows:

The cam shaft 16 is rotated in accordance with rotation of an engine (not shown) and then the six plungers 18 whose heads mate with the cam surface of the eccentric cam 17 are reciprocated.

According to the reciprocating movement of the six plungers 18, the fluid within the tank (not shown) is introduced through intake conduit I via the inlet port 28 into the low-pressure chamber 11 and then the fluid within the low-pressure chamber 11 is pressurized in each of the plunger chambers 19 in the order of their reciprocation.

The pressurized fluid within each plunger chamber 19 is fed through each of the six fluid passages 21 via each of the check valves 13 into the high-pressure chamber 12 in the same order. The pressures of the pressurized fluids fed from each of the plunger chambers 19 become uniform in the high-pressure chamber 12.

The uniformly high-pressure fluid is supplied through the outlet port 30 via the discharge conduit E into the predetermined hydraulic element, such as a control valve of a power steering system for automotive vehicles.

As will be appreciated from the above, since the plunger pump assembly of the preferred embodiment according to the invention is comprised of a single casing element and bolts are not used for assembling the pump assembly at all, the pump assembly is compact and has a highly rigid plunger casing. Also, the plunger pump of the invention does not have the connecting surface between a low-pressure casing and a high-pressure casing as in prior art plunger pump assemblies, thereby avoiding leakage of oil between the low-pressure and high-pressure chambers. Furthermore, in the plunger pump assembly according to the invention, the parts assembled in the low-pressure chamber may be easily maintained by removing the oil seal and the bearing stopper ring, while the parts assembled in the high-pressure chamber may be maintained by removing the lock ring. Therefore, when comparing the plunger pump of the invention with the two-split type of prior art plunger pump, the plunger pump of the invention has a higher maintainability than that of the prior art plunger pump, because there is of no use of bolts as fastening means between two casing elements. Moreover, the plunger pump of the invention never requires a predetermined torque adjustment to tighten bolts, but instead the lid for the high-pressure chamber is supported by the lock ring and the compression coil spring.

Although, in the preferred embodiment, the plunger pump assembly has six plungers, six plunger chambers, six fluid passages, and six check valves, the number of plungers, plunger chambers, fluid passages, and check valves may all be suitably changed depending upon the required amount of discharge and the required discharge pressure of fluid.

While the foregoing is a description of the best mode for carrying out the invention, it will be understood that the invention is not limited to the particular embodiment shown and described herein, but may include variations and modifications without departing from the scope or spirit of this invention as described by the following claims.

What is claimed is:

1. A plunger pump including at least one plunger chamber slidably accommodating a plunger associated with and radially arranged relative to a rotatable cam shaft having a driven connection with an engine, for pressurizing fluid within said plunger chamber, comprising:

a substantially cylindrical member for defining an internal space therein, said cylindrical member having an inlet port for introducing fluid into said internal space and an outlet port for discharging fluid from said internal space;

a partition member radially and inwardly extending from the inner peripheral wall of said cylindrical member, for dividing said internal space of said cylindrical member into a low-pressure chamber communicating with said inlet port and a high-pressure chamber communicating with said outlet port, said partition member being integrally connected to said cylindrical member;

means for blocking and establishing communication between said plunger chamber and said low-pressure chamber depending on the position of said plunger during reciprocating operation of said plunger;

means for communicating said plunger chamber with said high-pressure chamber, said communicating means being formed in said partition member;

said cylindrical member defining a first opening through which said cam shaft is inserted into said low-pressure chamber and a second opening through which said check valve is inserted into said high-pressure chamber;

means for sealingly closing said second opening in such a manner as to be proof against the high-pressure of pressurized fluid in said plunger chamber; and said closing means being firmly supported by a lock ring inserted into a groove formed in the inner peripheral wall of said cylindrical member and a compression spring arranged within said high-pressure chamber for normally biasing said closing means to said lock ring.

2. A plunger pump including at least one plunger chamber slidably accommodating a plunger associated with and radially arranged relative to a rotatable cam shaft having a driven connection with an engine, for pressurizing fluid within said plunger chamber, comprising:

a substantially cylindrical member for defining an internal space therein, said cylindrical member having an inlet port for introducing fluid into said internal space and an outlet port for discharging fluid from said internal space;

a partition member radially and inwardly extending from the inner peripheral wall of said cylindrical member, for dividing said internal space of said cylindrical member into a low-pressure chamber communicating with said inlet port and a high-pressure chamber communicating with said outlet port, said partition member being integrally connected to said cylindrical member;

means for blocking and establishing communication between said plunger chamber and said low-pressure chamber depending on the position of said plunger during reciprocating operation of said plunger, said means being formed in the outer peripheral wall of said plunger;

means for communicating said plunger chamber with said high-pressure chamber, said communicating means being formed in said partition member, said communicating means having a corresponding threaded opening which is communicated therewith via said partition member and which is exposed to said high-pressure chamber for mounting a check valve on said partition member in such a manner as to introduce flow of the pressurized fluid from said plunger chamber into said high-pressure chamber and to block flow of the pressurized fluid from said high-pressure chamber to said plunger chamber;

said cylindrical member defining a first opening through which said cam shaft is inserted into said low-pressure chamber and a second opening through which said check valve is inserted into said high-pressure chamber;

means for sealingly closing said second opening in such a manner as to be proof against the high-pressure of the pressurized fluid in said plunger chamber; and said closing means being firmly supported by a lock ring inserted into a groove formed in the inner peripheral wall of said cylindrical member and a compression spring arranged within said high-pressure chamber for normally biasing said closing means to said lock ring.

3. The plunger pump as set forth in claim 2, further comprising:

means for supporting one end of said rotatable shaft, said supporting means including a cylindrical hollow formed in said partition member.

* * * * *